US007309364B1

(12) United States Patent
Wagenknecht et al.

(10) Patent No.: US 7,309,364 B1
(45) Date of Patent: Dec. 18, 2007

(54) PADDLE BLADE END WITH SIDEWALLS FORM ECCENTRIC SHAFT

(76) Inventors: Charles Maxwell Wagenknecht, 6693 Heather La., Rockford, IL (US) 61114; Samuel James Wagenknecht, 6693 Heather La., Rockford, IL (US) 61114; Terry Lee Wagenknecht, 6693 Heather La., Rockford, IL (US) 61114

( * ) Notice: Subject to any disclaimer, the term of this patent is extended or adjusted under 35 U.S.C. 154(b) by 0 days.

(21) Appl. No.: 11/603,468

(22) Filed: Nov. 22, 2006

(51) Int. Cl.
*B63H 16/04* (2006.01)

(52) U.S. Cl. ..... 44/101

(58) Field of Classification Search ..... 440/101, 440/102; 416/69, 70 R, 74; D12/215
See application file for complete search history.

(56) References Cited

U.S. PATENT DOCUMENTS

| | | | | | |
|---|---|---|---|---|---|
| 560,980 | A | * | 5/1896 | Dunlap | 416/74 |
| 1,499,490 | A | * | 7/1924 | Weil | 416/70 R |
| 1,789,749 | A | * | 1/1931 | Herring | 416/70 R |
| 2,343,726 | A | * | 3/1944 | Witt | 416/74 |
| 3,186,714 | A | * | 6/1965 | Berendt et al. | 473/505 |
| 4,303,402 | A | * | 12/1981 | Gooding | 440/101 |
| 4,622,017 | A | | 11/1986 | McGraw | 440/401 |
| 4,842,482 | A | * | 6/1989 | Beckerer, Jr. | 416/70 R |
| D335,274 | S | * | 5/1993 | Beckerer, Jr. | D12/215 |
| 5,830,024 | A | | 11/1998 | Killen | 440/101 |

OTHER PUBLICATIONS

Disclosure Doc. # 603281.

* cited by examiner

*Primary Examiner*—Ed Swinehart

(57) ABSTRACT

A foldable paddle blade and shaft comprises a planar elongate polymer plastic substrate with two angularly directioned weakened hinge lines (71) which extend inwardly and angularly from a location at or near one elongate end of the substrate's lateral edges to form a blade with sidewalls (46) and a free terminal end (30). Paralleling weakened hinge lines (72) parallel and traverse the at least three faceted tubular shaft (50),(51). In an alternative embodiment, additional paralleling weakened hinge lines (72),(73) and tabular projections (42) may form a four faceted or square shape tubular shaft (52). The paddle blade's three faceted or more eccentric tubular shaft's shape may be in a triangular, a square, or an open sided c-channel shape. A difference in axis between the paddle blade's planar axis and the shaft's elongate axis further strengthens the overall structure in at least one direction. The improvement is a flat substrate which can be easily and more conveniently stored within small areas of most any water craft before being foldingly assembled.

11 Claims, 11 Drawing Sheets

Fig. 1,a
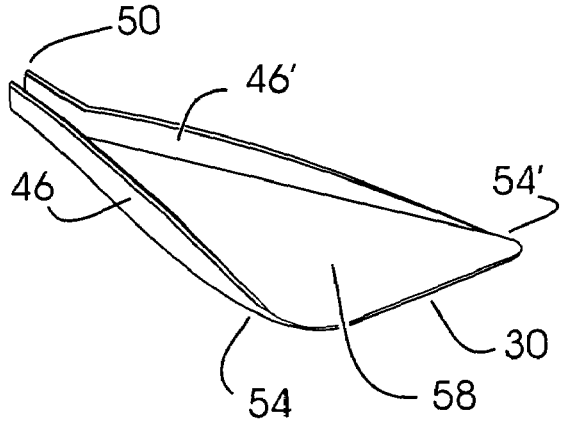
Fig. 1,b
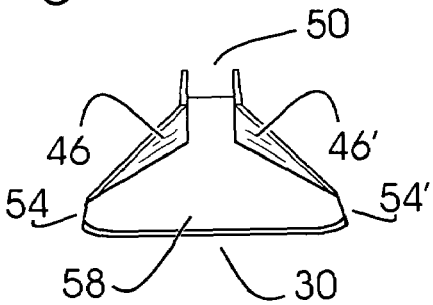
Fig. 1,c
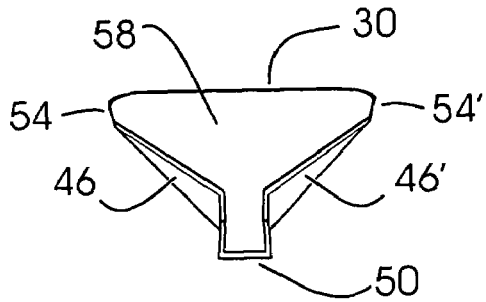

Fig. 2,a
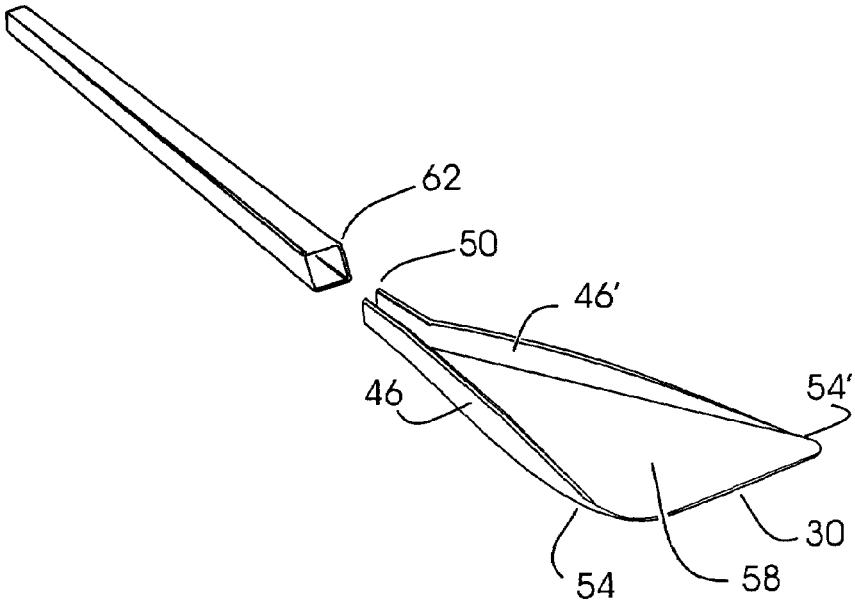
Fig. 2,b
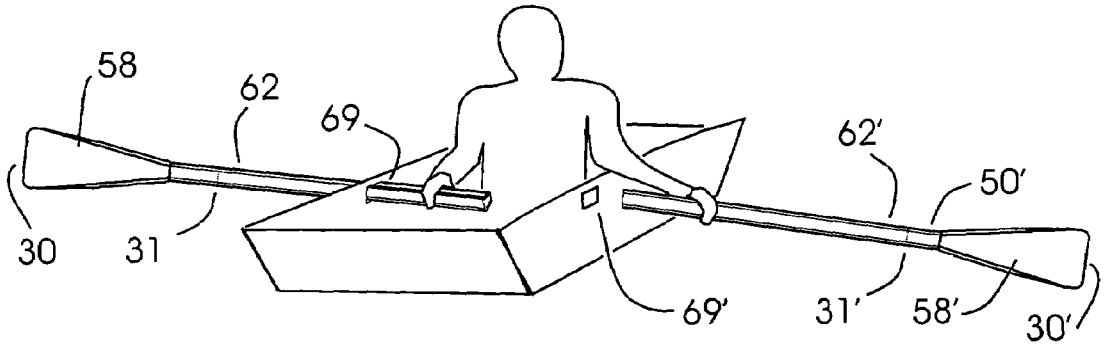

Fig. 3,a
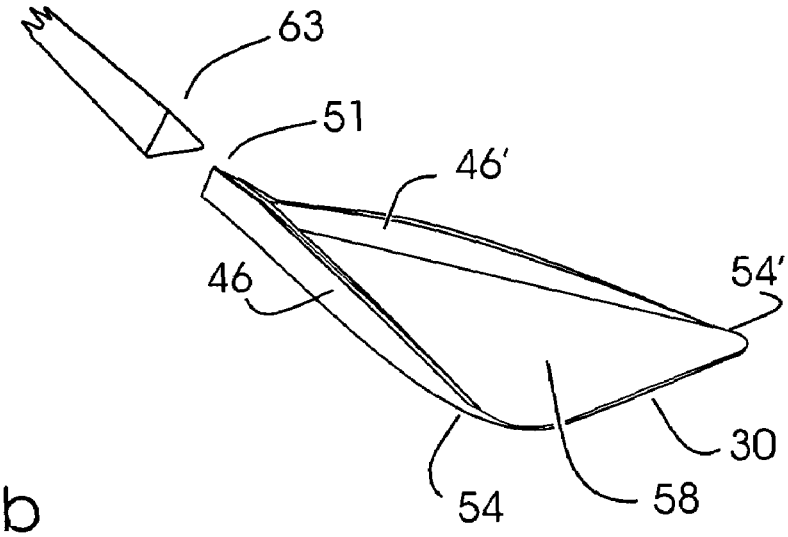
Fig. 3,b
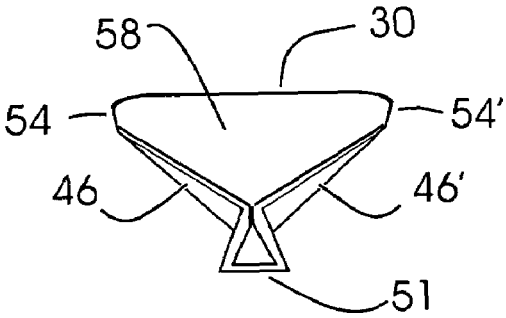
Fig. 3,c
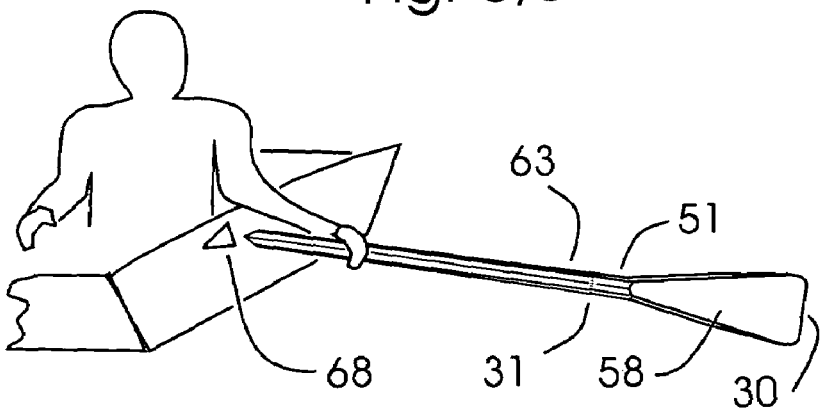

Fig. 4,a
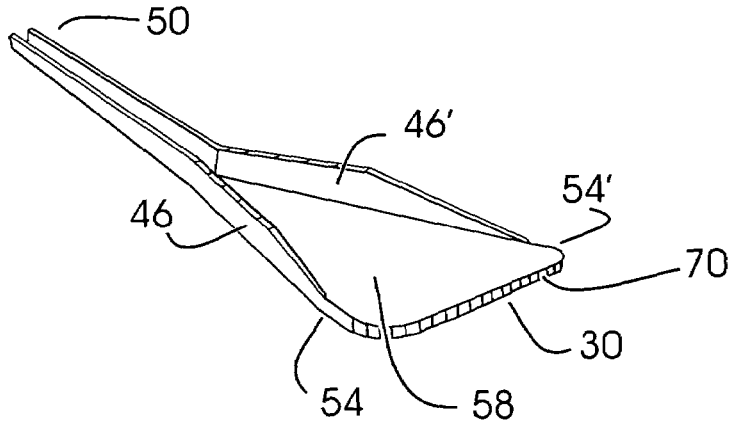
Fig. 4,b
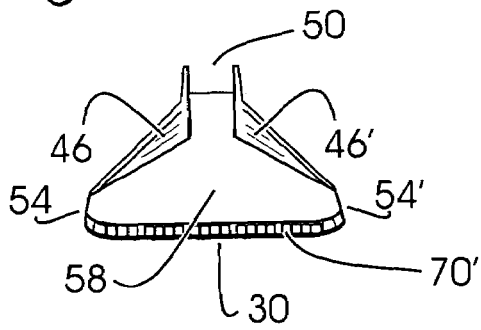
Fig. 4,c
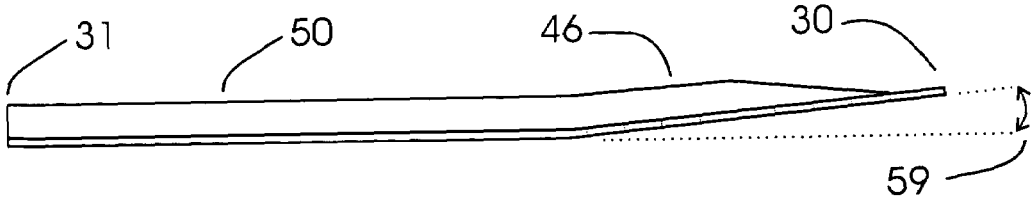

Fig. 6,a
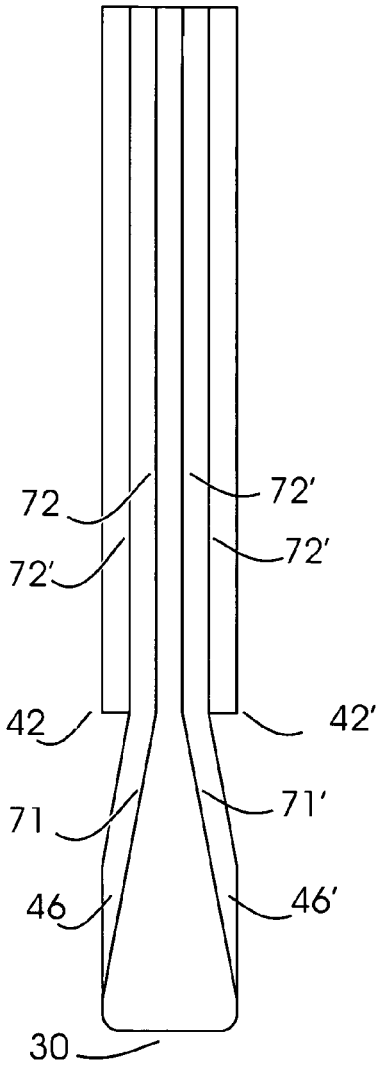
Fig. 6,b
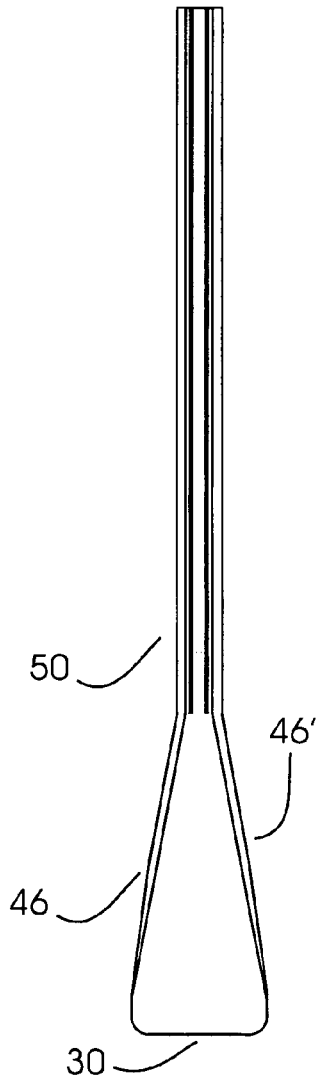
Fig. 6,c
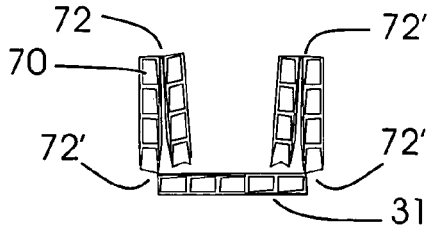

Fig. 7,a
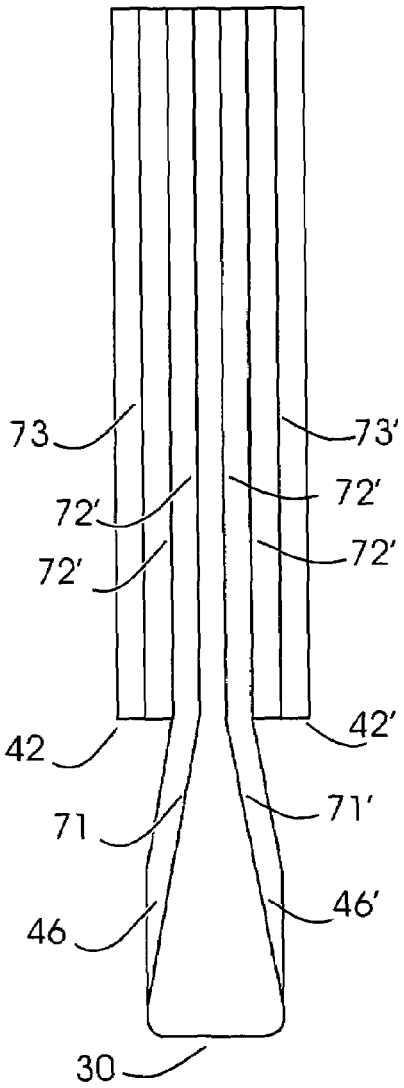
Fig. 7,b
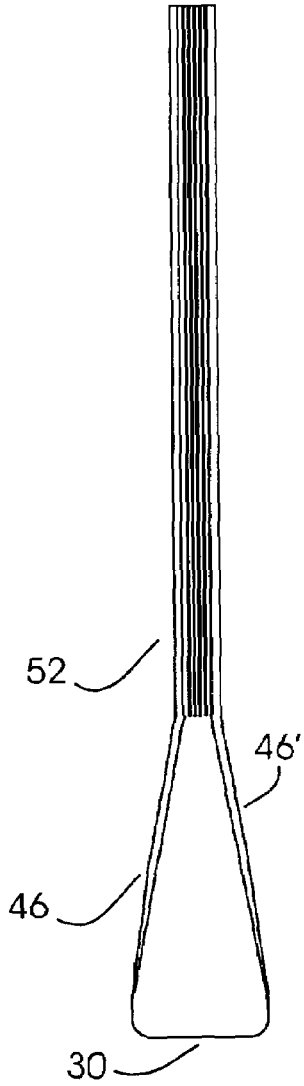
Fig. 7,c
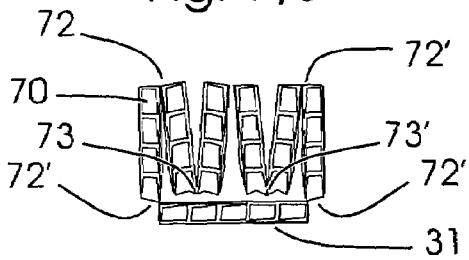

Fig. 12,a
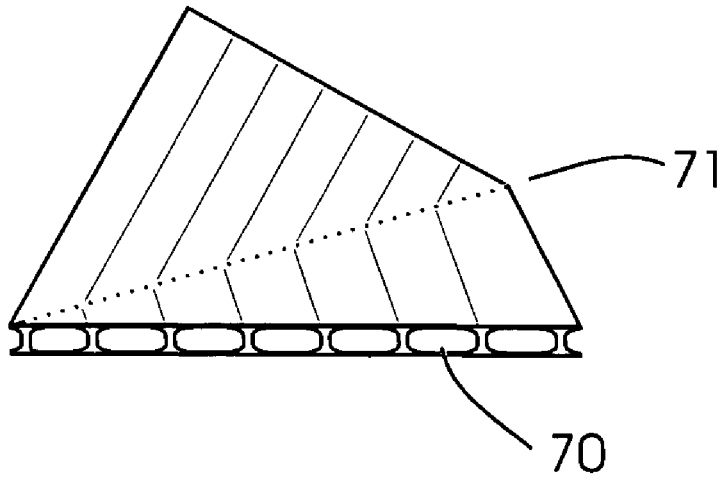
Fig. 12,b
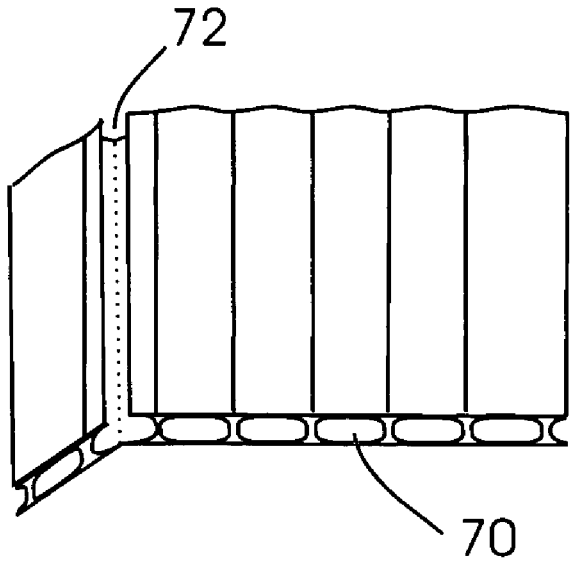

PADDLE BLADE END WITH SIDEWALLS FORM ECCENTRIC SHAFT

CROSS-REFERENCE TO RELATED APPLICATIONS

None

STATEMENT REGARDING FEDERALLY SPONSORED RESEARCH OR DEVELOPMENT

Not applicable.

REFERENCE TO SEQUENCE LISTING

Not applicable.

BACKGROUND

1. Field of Invention

This invention relates to foldable paddle blades and shafts which are constructed from a single piece of generally planar and elongate polymer plastic material, and to those types of foldable paddle blades and shafts which are foldingly assembled from their original completely flat and planar state.

2. Description of Prior Art

No prior art was found to exist concerning foldable paddle blades and shafts which are constructed from one single planar polymer plastic substrate and which are foldingly assembled from their original completely flat and planar state.

3. Objects and Advantages

This new concept of a foldable paddle and shaft may be more easily and compactingly stored in many more locations of a small water craft, or any larger water craft. It's unassembled and flat proportions of approximately ¼ inch by 6 inches by 4 feet or longer may be easily stacked in one area, or temporarily adhered or velcroed to a vessel's inner walls or most anywhere before folding it by hand into its assembled and ready to row form.

An alternative embodiment of corrugated polymer plastic floats on its own, while the 3 faceted or more shafts of all embodiments aid the user in retaining a correct angle of attack when striking and pushing through the water; and while either when a shaft is being held by hand, or when the shaft extends into or through a cooperatingly receptive aperture or hole.

SUMMARY

A foldable paddle blade comprises a generally planar and elongate polymer plastic substrate with two weakened hinge lines which extend inwardly and angularly from a location at or near one elongate end of the substrate's lateral edges to form a generally triangular shape blade with two sidewalls and a free terminal end. The angular weakened hinge lines change direction to parallel the substrate's elongate length to form an at least three faceted tubular shape shaft. The initially flat substrate may be folded into a paddle blade with a shaft having an at least 3 or more faceted tubular shape, and with the shaft being eccentric or deviate in axis direction from the blade's planar surface axis.

BRIEF DESCRIPTION OF THE DRAWINGS

Reference Numerals in Drawings

30. Paddle blade's open or free terminal end

Figure 5:
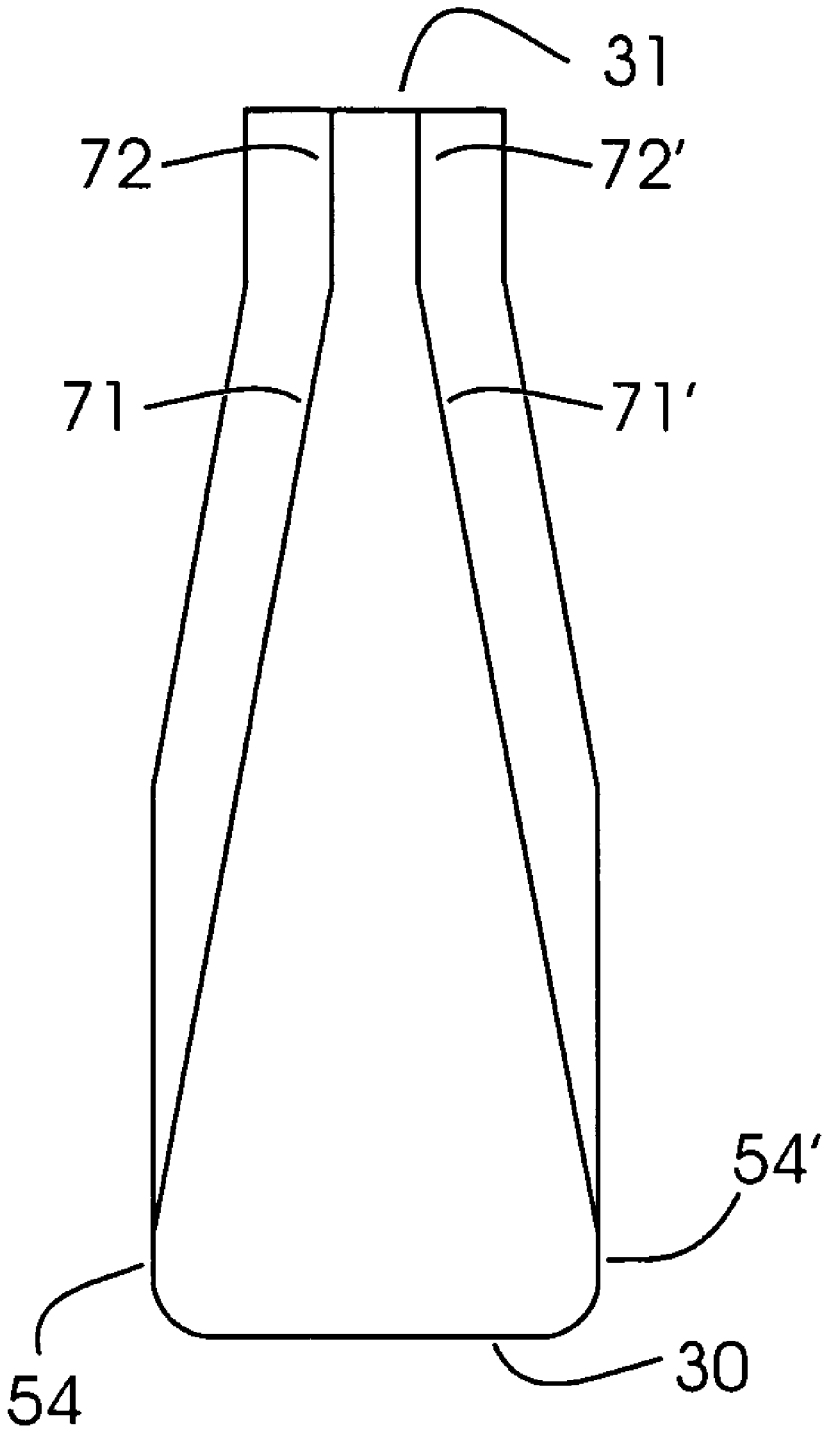

31. the distal end located opposite paddle blade's open or free terminal end

42. A paddle blade shaft's extending shaft handle forming tab

46. Sidewall

50. A paddle's 3 faceted tubular shaft in elongate C-channel shape

51. A paddle's 3 faceted tubular shaft in elongate triangular shape

52. A paddle's 4 faceted tubular shaft in elongate square shape

54. A paddle blade's elongate edge

58. A paddle blade's planar surface which opposes the water

59. Angle of axis difference between planar blade and elongate tubular shaft

62. Separate oar with receptive 4 faceted tubular shaft in elongate square shape

63. Separate oar with receptive 3 faceted tubular shaft in elongate triangular shape

68. Triangular shaped oar hole aperture

69. Square shaped oar hole aperture

70. Elongate flutes of corrugated plastic substrate

71. a hinge line angular to a blade's elongate length

72. a hinge line parallel to a blade's elongate length

73. a hinge line parallel to a blade's elongate length and located on the opposite side of the paddle as the planar surface which strikes the water.

74. a perpendicular to the flute's elongate direction weakened hinge line

BRIEF DESCRIPTION OF THE DRAWINGS

In the drawings, closely related figures may have the same number, but different alphabetic suffixes.

FIG. 1, *a*; An perspective view of a preferred embodiment.

FIG. 1, *b*; An end view of a preferred embodiment from the paddle's open terminal end.

FIG. 1, *c*; An end view of a preferred embodiment from the paddle's shaft handle.

FIG. 2, *a*; A perspective view of a preferred embodiment with a cooperating oar shaft.

FIG. 2, *b*; A frontal perspective view of a man in boat inserting an oar and its attached preferred embodiment within a receptive square shaped oar hole aperture.

FIG. 3, *a*; A perspective view of an alternative embodiment being inserted into an oar's receptive end hole.

FIG. 3, *b*; An end view of an alternative embodiment from the paddle's shaft handle, and showing a three faceted, triangular shape shaft.

FIG. 3, *c*; A frontal perspective view of a man in boat inserting an oar and its attached alternative embodiment within a receptive triangular shaped oar hole aperture.

FIG. 4, *a*; A perspective view of an alternative embodiment formed from a corrugated plastic substrate and with a c-channel tubular shaft shape.

FIG. 4, *b*; An end view of an alternative embodiment formed from a corrugated plastic substrate, and with a c-channel tubular shaft shape.

FIG. 4, *c*; A side view of an alternative embodiment formed from a corrugated plastic substrate, and with a c-channel tubular shaft shape, and showing an angle of the paddle blade in relationship to the shaft.

FIG. 5; An overhead view of both a preferred embodiment in a flattened state, while also being applicable to an alternative embodiment in a flattened state.

In the drawings, closely related figures may have the same number, but different alphabetic suffixes.

FIG. 6, *a*; An overhead view of an alternative embodiment of corrugated plastic in a flattened state showing elongate tabular projections and hinge line locations.

FIG. 6, *b*; An overhead-view of an alternative embodiment of corrugated plastic in an assembled position with a c-channel tubular shape shaft.

FIG. 6, *c*; An end view of an alternative embodiment of corrugated plastic and showing its c-channel tubular shape.

FIG. 7, *a*; An overhead view of an alternative embodiment of corrugated plastic in a flattened state showing tabular projections and additional hinge line locations.

FIG. 7, *b*; An overhead view of an alternative embodiment of corrugated plastic in an assembled position with a square tubular shape shaft.

FIG. 7, *c*; An end-view of an alternative embodiment of corrugated plastic and showing one embodiment of a square tubular shape.

Figure 8:
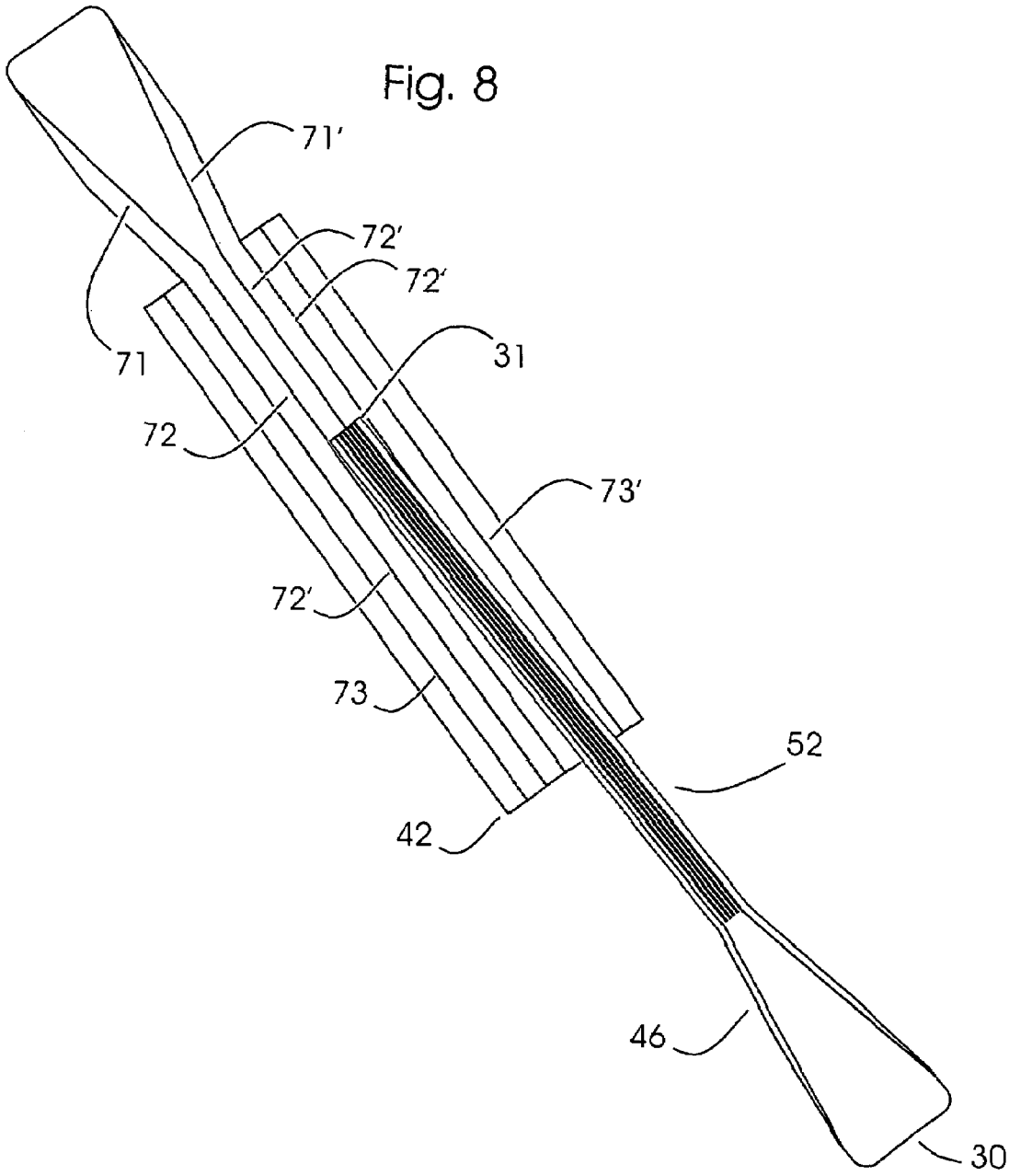

FIG. 8; An overhead view of two, square tubular shape alternative embodiments with one assembled, and positioned within the other before its folding and assembly.

Figure 9:
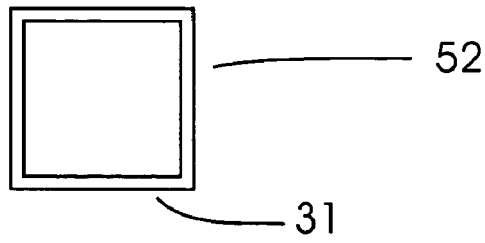

FIG. 9; An end view of an alternative embodiment's square shape shaft.

Figure 10:
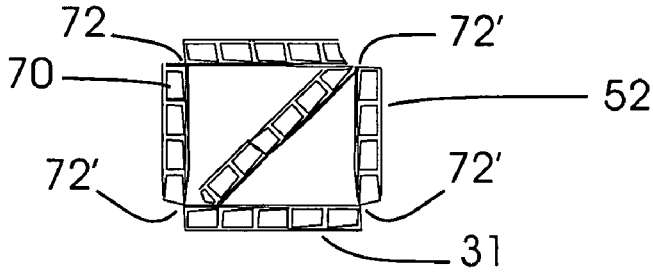

FIG. 10; An end view of one alternative embodiment's square shape shaft.

Figure 11:
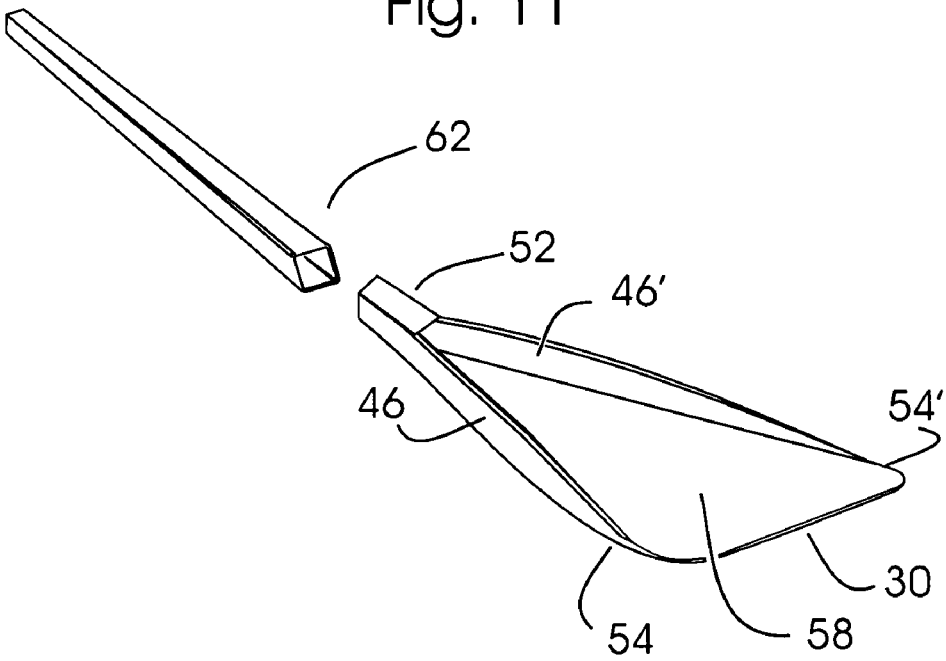

FIG. 11; A perspective view of an alternative embodiment's square shape shaft, and a separate matchingly shaped oar handle.

FIG. 12, *a*: A perspective view of corrugated plastic with an angular hinge line.

FIG. 12, *b*: A perspective view of corrugated plastic with a parallel hinge line.

Figure 13:
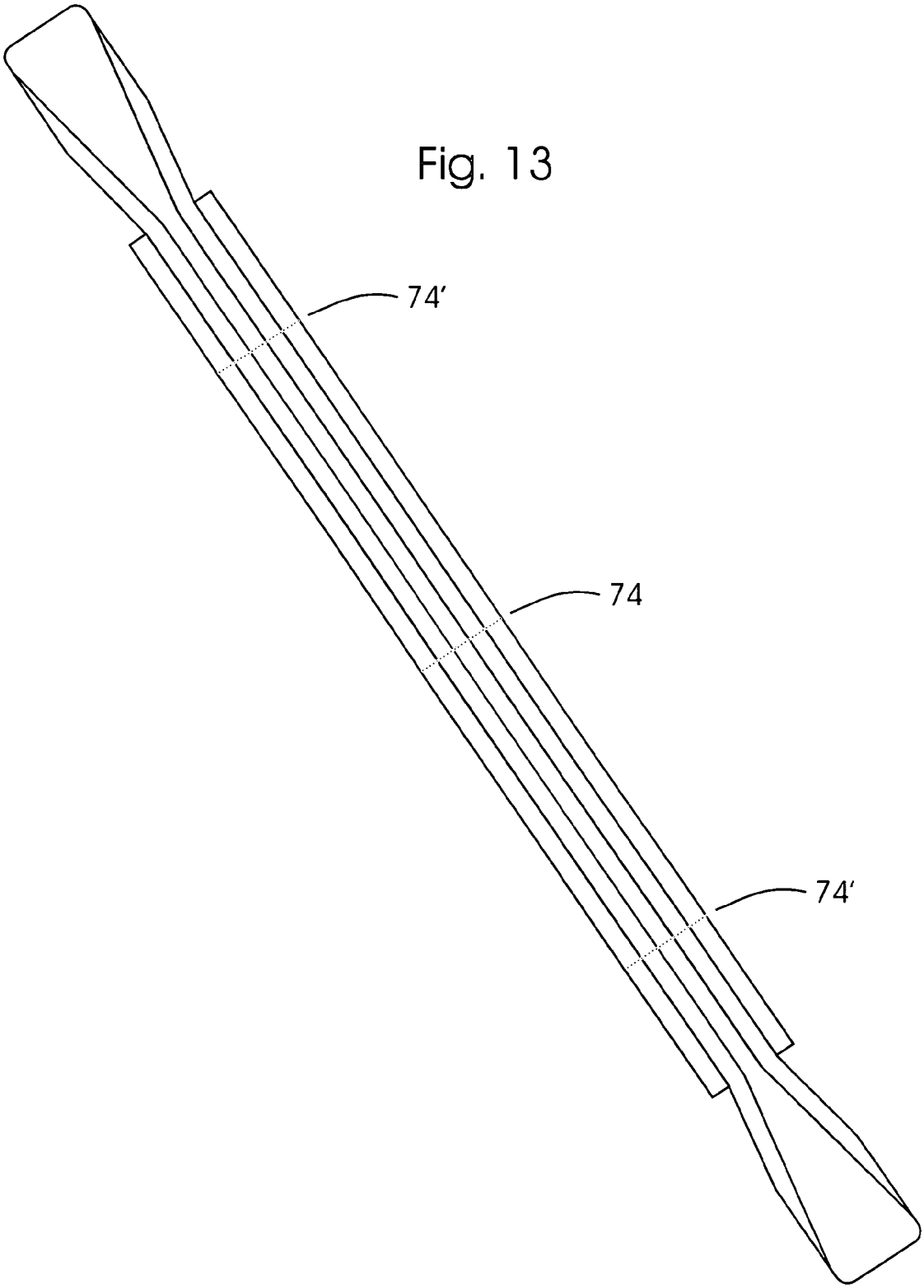

FIG. 13: An overhead view of an alternative embodiment of a corrugated plastic paddle(s) in a flattened state.

DETAILED DESCRIPTION OF THE DRAWINGS

FIG. 1, *a*

Preferred Embodiment

A flat and generally planar elongate triangular polymer plastic shape is marginally chamfered within two corners located at one elongate end, and establishes a paddle's free terminal end (30). At a location which is nearly two inches further inward, a sidewall (46) begins to project perpendicularly from each elongate edge (54) of one side of the paddle's planar surface (58) which strikes the water. An upward tapering of the two walls increases in height while continuing further inward for a distance which equals approximately one third of the paddle body's length. Their heights then parallel the paddle's planar surface (58) until reaching a location of the blade's shaft. The blade's thickness is generally equal throughout its main body, and is approximately one quarter inch or more in thickness. The free terminal end (30) is the widest portion of the blade, and where at a location at about two or three inches inward, its width decreases and tapers laterally-inward. The inward tapering of the blade's body results in an overall elongate triangular shape, and terminates at a location where the blade's planar body merges with the two sidewalls to form a three faceted c-channel tubular shape (50), and with the c-channel tubular shape's length being approximately three inches long in the perspective view of the preferred embodiment in FIG. 1, *a*. The overall dimensions are generally six inches in width by nineteen inches in length, and with the c-channel's shaft being just over one and one half inches by one and one half inches.

DETAILED DESCRIPTION OF THE DRAWINGS

In the drawings, closely related figures may have the same number, but different alphabetic suffixes.

FIG. 1, *a*; A perspective view of a preferred embodiment showing a paddle's open terminal end (30), two elongate edges (54), two sidewalls (46), and a c-channel shaped tubular shaft (50).

FIG. 1, *b*; An end view of a preferred embodiment and viewed from the paddle's open terminal end showing a paddle's open terminal end (30), two elongate edges (54), two sidewalls (46), and a c-channel shaped tubular shaft (50), and the planar surface of the paddle which strikes the water (58).

FIG. 1, *c*; An end view of a preferred embodiment and viewed from the paddle's shaft handle, showing the paddle's open terminal end showing a paddle's open terminal end (30), two elongate edges (54), two sidewalls (46), and a c-channel shaped-tubular shaft (50), and the planar surface of the paddle which strikes the water (58).

FIG. 2, *a*; A perspective view of a preferred embodiment shown with a separate and receptive oar shaft which contains a four faceted square shape end hole (62), and also showing a paddle's comprisements including; a paddle's open terminal end (30), two elongate edges (54), two sidewalls (46), and a c-channel shaped tubular shaft (50), and the planar surface (58) of the paddle which strikes the water.

FIG. 2, *b*; A frontal perspective view of a man in boat inserting an oar with a four faceted square shape receptive end hole (62) and an attached preferred embodiment with a paddle's three faceted c-channel shape tubular shaft (50) inserted within the oar(s), and a paddle's distal end (31) represented by dotted lines. Also shown, is the paddle's planar surface (58) which strikes the water, and the paddle's free terminal end (30), and the boat's oar hole aperture (69) in a four faceted square shape.

FIG. 3, *a*; A perspective view of a preferred embodiment shown with a separate and receptive oar shaft which contains a three faceted triangular shape end hole (63), and showing a paddle's comprisements including; a paddle's open terminal end (30), two elongate edges (54), two sidewalls (46), and a triangular shaped tubular shaft (51), and the planar surface (58) of the paddle which strikes the water. FIG. 3, *b*; An end view of an alternative embodiment viewed from the paddle's shaft handle, and showing a three faceted triangular shape shaft (51), the paddle's open terminal end (30), two elongate edges (54), two sidewalls (46), and the planar surface of the paddle which strikes the water (58).

FIG. 3, *c*; A frontal perspective view of a man in boat inserting an oar with a three faceted triangular shape receptive end hole (63) and an attached preferred embodiment with a paddle's three faceted triangular shape tubular shaft (51) inserted within the oar, and a paddle's distal end (31) represented by dotted lines. Also shown, is the paddle's planar surface (58) which strikes the water, and the paddle's free terminal end (30), and the boat's oar hole aperture (68) in a three faceted triangular shape.

FIG. 4, *a*; A perspective view of an alternative embodiment formed from a corrugated plastic substrate and with a c-channel tubular shaft shape (50), and a paddle's free terminal end (30), two elongate edges (54), two sidewalls (46), and the planar surface (58) of the paddle which strikes the water and the elongate flutes (70) of the corrugated plastic substrate.

FIG. 4, *b*; An end view of an alternative embodiment formed from a corrugated plastic substrate, and with a c-channel tubular shaft shape (50), and a paddle's free terminal end (30), two elongate edges (54), two sidewalls (46), and the planar surface (58) of the paddle which strikes the water and the elongate flutes (70) of the corrugated plastic substrate.

FIG. 4, *c*; A side view of an alternative embodiment formed from a corrugated plastic substrate, and showing a location of the paddle's free terminal end (30), and a location of the c-channel tubular shaft shape (50), and a sidewall (46), and showing an angular difference between the paddle blade and the elongate c-channel tubular shaft (59), and a distal end (31) located opposite the free end.

FIG. 5; An overhead view of both a preferred embodiment in a flattened state, while also being applicable to a flattened alternative embodiment. Shown are locations of a paddle's free terminal end (30), the end opposite the free terminal end (31), the blade's elongate edges (54), hinge lines or bend locations which are angular to the blade's elongate length (71), and hinge lines which are parallel to the blade's elongate length (72).

FIG. 6, *a*; An overhead view of an alternative embodiment using a corrugated plastic substrate in a flattened state showing elongate tabular projections (42) and angular hinge line (71) locations, and parallel hinge line (72) locations, and a paddle's free terminal end location (30), and sidewall (46) locations.

FIG. 6, *b*; An overhead view of an alternative embodiment of corrugated plastic as in FIG. 6, *a*, but in an assembled position with a c-channel tubular shape shaft (50), and sidewalls (46), and the paddle's free terminal end (30).

FIG. 6, *c*; An end view of an alternative embodiment of corrugated plastic and showing its c-channel tubular shaped distal end (31) which is opposite the paddle's free terminal end, and showing the openings of the corrugated material's elongate flutes (70), and locations of parallel hinge lines (72).

Note that up to this point in all drawings of alternative embodiments using corrugated plastic, all hinge lines within the three faceted or more tubular shape shaft are located on one planar side of the substrate, and on the same side as the paddle's surface which strikes the water (58).

The following alternative embodiment utilizing corrugated plastic material in FIGS. 7, *a*through 7, *c* will require an additional plurality of paralleling hinge lines on the substrate's opposite planar surface, and on the opposite side as the paddle's surface which strikes the water (58).

FIG. 7, *a*; An overhead view of an alternative embodiment using a corrugated plastic substrate in a flattened state showing elongate tabular projections (42) and angular hinge line (71) locations, and parallel hinge line (72) locations, and a paddle's free terminal end location (30), and sidewall (46) locations, and parallel hinge lines which are located on an opposite side as said planar surface which strikes the water (73).

FIG. 7, *b*; An overhead view of an alternative embodiment of corrugated plastic as in FIG. 7, *a*, but in an assembled position with a square tubular shape shaft (52), and sidewalls (4-6), and the paddle's free terminal end (30).

FIG. 7, *c*; An end view of an alternative embodiment of corrugated plastic and showing its square tubular shaped distal end (31) which is opposite the paddle's free terminal end, and showing the openings of the corrugated material's elongate flutes (70), and locations of parallel hinge lines (72), and oppositely located parallel hinge lines (73).

FIG. 8; An overhead view of two, eccentric shaft shaped alternative embodiments with a first embodiment completely assembled, and positioned within a second embodiment before its folding and surrounding assembly around the first embodiment's elongated handle shaft, and showing the same basic elements previously described in FIGS. 7, *a*and 7, *b*.

FIG. 9; An end view of an alternative embodiment's square shape shaft (52), as when injection molding the embodiment, and shown from a distal end (31) which is opposite a blade's free terminal end.

FIG. 10; An end view of one alternative embodiment's square shaped shaft (52), and as when formed from a corrugated plastic, and shown from the paddle's distal end (31), and showing the open ends of the corrugation's elongate flutes (70), and showing hinge lines (72) which parallel the paddle's elongate length.

FIG. 11; A perspective view of an injection molded alternative embodiment's square shaped shaft (52), and a separate matchingly shaped oar handle (52), and showing two sidewalls (46), elongate edges (54), the paddle's free terminal end (30), and the planar surface of the paddle which strikes the water (58).

FIG. 12, *a*: A perspective view of corrugated plastic with an angular hinge line (71), and showing the hinge as dotted line, and a flute opening (70).

FIG. 12, *b*: A perspective view of corrugated plastic with a parallel hinge line (72), and showing the hinge as a dotted line, and a flute opening (70).

FIG. 13: An overhead view of an alternative embodiment of a corrugated plastic paddle(s) in a flattened state, and showing where a previous distal end merges with another to form a double bladed kayak paddle, and showing a perpendicular to the flute's elongate direction weakened hinge line (74), and traversing the entire shaft's lateral width.

A paddle blade end with sidewalls is formed from a manufacturer's chosen formula of polymer plastic resins or co-polymer resins, and where the preferred embodiment is most likely injection molded.

A flat and generally planar elongate triangular polymer plastic shape is marginally chamfered within two corners located at one elongate end, and establishes a paddle's free terminal end (30). At a location which is nearly two inches further inward, a sidewall (46) begins to project perpendicularly from each elongate edge (54) of one side of the paddle's planar surface (58) which strikes the water. An upward tapering of the two walls increases in height while continuing further inward for a distance which equals approximately one third of the paddle body's length. Their heights then parallel the paddle's planar surface (58) until reaching a location of the blade's shaft.

The blade's thickness is generally equal throughout its main body, and is approximately one quarter inch thick. The free terminal end (30) can be defined as the widest portion of the blade, and where at a location at about two or three inches inward, its width decreases and tapers laterally inward. The tapering of the blade's body results in an overall elongate triangular shape, and terminates at a location where the blade's planar body merges with the two sidewalls to form a three faceted c-channel tubular shape (50), and which may be a few inches long as shown in FIG. 1, *a*, or it may be longer to form a handle.

The overall dimensions are generally six inches in width by nineteen inches in length, and with the c-channel's shaft being approximately one and one half by one and one half inches. inches by one and one quarter inches. FIG. 5 shows how the preferred embodiment would appear if it were in a flattened state before its forming. Hinge lines or bend locations are described as angular hinge lines (71) which are not parallel with the paddle's overall elongate length, and also shown are the parallel hinge lines (72), which are parallel with the paddle's length.

When a manufacturer chooses to make a paddle blade with the shorter c-channel tubular shaft (50) of FIG. 1, *a*, they may insert the overall square shape of the c-channel shape into a receptive square shaped tubular oar handle (62) as shown in FIG. 2, *a*. The four faceted square shape oar handle will keep a novice paddler constantly aware of the rotational angle at which the paddle blade is striking the water. When the same oar and paddle combination are inserted into a matchingly shaped oar hole aperture such as shown in FIG. 2, *b*, the angle of attack at which the oar strikes the water is firmly locked into position, and also that position which the manufacturer decides is best. In FIG. 2, *b*, the distal end location of the c-channel shape (50) is identified as the paddle blade's distal end (31), and is drawn with dotted lines.

When a manufacturer chooses, the distal end (31) may continue in its length to form the entire-oar handle shaft, and where the overall square shape of the c-channel will function in the same way to precisely lock the angle of attack, and when the water craft's oar hole's square shape aperture (69) is properly sized to fit the square shaped c-channel (50). In this embodiment of a complete eccentric shaft paddle blade and its elongated shaft handle, a wall thickness of three sixteenths inch or more is preferable.

When a very light weight plastic or thin walled paddle of about one eighth inch thick is chosen by the manufacturer, the overall shape of a c-channel shape and the paddle blade end may twist slightly when held by a paddling user's two hands, but either a square tube oar handle (62), or especially a square shape oar hole aperture (69) will retain the paddle's original shape when under the stresses of pushing water.

An eccentric shaft's paddle blade is stronger in one direction than another, and is stronger in a direction which one specific planar surface (58) strikes the water, and is labeled in FIGS. 2, *a* (58), and 2, *b* (58).

An eccentric shaft paddle blade may also be configured with a triangular shape tubular shaft as shown in FIGS. 1, *a,b*, and *c*. Most previous descriptions of how to make and use the eccentric shaft paddle blade with a c-channel shape tubular shaft will also apply to this embodiment. A compatible matching three faceted triangular shaped tubular oar (63) is shown in FIGS. 3, *a*, and 3, *c*; and also a water craft's triangular shape oar hole aperture (68) in FIG. 3, *c*. The three faceted triangular tubular shape shaft (51) functions as an eccentric surface for a novice paddler to be constantly aware of the rotational position of the shaft and paddle blade, and so the angle of attack in which the paddle strikes the water; and a shaft handle's rotationally fixed position within a water craft's triangular shape oar hole's aperture (68) leaves no margin for error.

An alternative embodiment uses a corrugated plastic sheet substrate which is from at least one manufacturer, made from a polypropylene co-polymer resin.

Corrugated plastic sheets come in a wide range of thicknesses and in sheet stock sizes of four feet by eight feet or longer. The corrugated substrate is similar to a double wall paperboard or cardboard material, and where the corrugated plastic sheets comprise a plurality of paralleling elongate flutes which traverse from end to end in one direction.

This substrate may be die cut with the addition of weakened hinge lines being made by crimps, heat bends, or slits within one or more planar surface(s). The hinge lines may be made as the substrate's planar form is being die cut, or after the die cutting is done.

Slits are preferable, as they provide a more precise location of bending, and where the substrate's opposite wall becomes a specifically located hinge, or bending location. Crimps are more general as to exactly where the material will bend when under a stress load. Heat bends can be made with precision, although they are permanent, and will prematurely age the substrate as they produce a more brittle and fracture-able material.

Note FIG. 12, *a* and FIG. 12, *b*; where slits are made on one planar side of a corrugated substrate, and where an opposite side forms a hinge. When making an angular slit which is cut angularly to the flute direction and on one planar surface, the material will be able to be bent along the cut line, and wherein the inner walls of the flute(s) will tear through the material's thickness until being stopped by the opposite planar wall, which then forms a hinge as in FIG. 12, *a* (71).

At least one manufacturer of corrugated polypropylene plastic describes the product as a living hinge; where tests have bent the polypropylene material twenty one thousand cycles at seventy two degrees fahrenheit.

The paddle must be formed with the substrates elongate flutes being aligned parallel with the elongate length of the paddle, as the most strength within this material's properties remains when applied pressure is placed either with or against the flutes' elongate direction, and with less strength being retained in laterally applied pressures. The flute openings (70) are shown in FIGS. 4, *a* and 4, *b*; and as they are so numerous, only one is labeled per element of the paddle's body, and only where completely visible to the viewer.

Referring again to FIG. 5, a viewer can see where the slits need to be made angularly to the paddle's elongate length. They are labeled hinge lines which are angular to the paddle's elongate length (71), and begin near the paddle's free terminal end (30), and also begin at the paddle's elongate edge (54), and continue inwardly and angularly from the elongate edge (54) until they abut the hinge lines which parallel the paddle's elongate length (72).

Also note how two exterior and elongate edges (54) begin to angle laterally inward at approximately a halfway location within the paddle's elongate length, and terminate their inward angles at or near where the angular hinge lines (71) abut the paralleling hinge lines (72). The two edges previously defined as the paddle's elongate edges (54) are now the shaft's exterior edges, and will be the c-channel shape tubular shaft's (50) exterior lips after assembly of the paddle.

Note how the drawings of FIGS. 4, *a* and 4, *b* are similar to those of FIGS. 3, *a* and 3, *b*; with the primary difference being the alternative substrate of corrugated plastic. Note also the flattened state of FIG. 5, and how it may represent either a preferred embodiment injection molded plastic, or an alternative embodiment of corrugated material. Both embodiments function as a low cost emergency paddle, but the corrugated plastic material does have several advantages.

When comparing ounce per ounce of raw material used to make the same paddle, a corrugated substrate uses much less plastic resin in its manufacture. The flutes may also be compared in their strength as a solid rod being compared to a hollow tube, and where an actual weighing of the materials is used in the comparison. With the goal being a light weight paddle, a tubular structure is less likely to bend, and as in the flute's tubular forms within corrugated plastic.

Another advantage is the materials inherent ability to float in water. The polypropylene co-polymer absorbs only 0.02% within a 24 hour time period according to one manufacturer. A small sliver of material will float almost indefinitely. A larger corrugated sheet within water currents may be swept under, but only after all the open ended flute channels are filled with water, and that process takes time; and which is between five to ten minutes in a small stream's currents, and which is usually enough time for a paddler to recover a lost oar and paddle. In a lake without currents, the material floats a much longer time.

One more advantage of the alternative embodiment of a corrugated substrate is shown in FIG. 4, *c*, where the distal end (31) of the c-channel shape tubular shaft (50) is extended for use as the paddle's shaft handle.

One alternative embodiment uses a same perimeter edge shape, cutting, and hinge lines as shown in FIG. 5, but with added tabular projections as shown in FIGS. 6, *a* and 6, *b* and 6, *c*. The tabs extend laterally an equal amount, as with the distance between the paddle's elongate edges near the shaft's formation and the first adjacent parallel hinge line. Note how the distances and segments between all paralleling hinge lines and including the exterior elongate edges of the projecting tabs are equal or nearly equal to each other as shown in FIG. 6, *a*, where the corrugated paddle is in a flattened state. After the paddle's assembly and as shown in FIG. 4, *c*; the sidewalls force the planar axis of the paddle to change about six degrees (59) in relation to the elongate axis of the elongated c-channel shape tubular shaft (50). This angle is formed as the sidewalls pull the paddle blade in a direction towards the paddle's planar surface which strikes the water, and so further reinforces the paddle's overall structure in at least one direction. When the paddle is un-assembled, or un-folded, it becomes completely flat and planar in form; and just as it was after it's die-cutting and hinge line forming slits were made. The angle of FIG. 4, *c* occurs in all assembled corrugated embodiments, and whether any extra tabs (42) of FIG. 6, *a* are formed or not, or whether the tubular shaft (50) is lengthened into a handle or not.

The unfolded state of the paddle shown in FIG. 6, *a* may be compactly stored within a small water craft for an emergency use for situations when a regular paddle goes overboard or comes up lost. The embodiment in FIG. 6, *a* has an overall size of only three sixteenths inch, by six inches, by forty eight inches.

After assembly, the paddle's overall strength when striking the water with the opposite side of the labeled surface of FIG. 4, *a* (58) is less than when striking the water with the correct surface (58); wherein the paddle's overall strength is surprisingly strong, and is due in part to the slight angle (59) shown in FIG. 4, *c*.

If a manufacturing user were to conduct a test of rowing upstream and against water currents, and with two corrugated plastic c-channel shape tubular extended handles inserted into a water craft's square shape oar hole aperture(s); the user could expect the following:

With each stroke made under extreme conditions, the paddle blade's planar surface and its sidewalls, and the first three to six inches of its shaft remain rigid, but the paddle's shaft may bow slightly in an area between the described first three to six inches area and a users handgrip location, or the water craft oar hole aperture's location. As the paddle is lifted from the water and pressures are removed, the material's residual memory regains the shaft's original posture.

The following alternative embodiment shown in FIG. 7, *a,b*, and *c* is purposed for reinforcing a corrugated paddle's extended shaft within fast water conditions. This alternative embodiment simply comprises an additional folding section within each tabular projection of the paddle's extended shaft. As shown in FIG. 6, *c*, all tabular projections are folded within the body of the open c-channel shape.

A cut through slit made within one planar surface permits an opposite planar surface to function as a hinge. All corrugated alternative embodiments illustrated so far, have had all hinge line forming slits made on the paddle's opposite side from where the sidewalls (46) are located, or opposite the paddle's planar surface which strikes the water (58). The embodiment of FIG. 7, *a,b*, and *c* requires two slits made on the same side of the paddle as the planar surface (58) which strikes the water. These slits are located nearest the two elongate tab projection's outermost elongate edge(s). Note paralleling hinge lines of FIG. 7, *a* (72) and (73). FIG. 7, *b* shows the paddle completely assembled, while FIG. 7, *c* shows one folding arrangement from the paddle's distal end (31). Note the locations of the two parallel hinge lines (73) of FIG. 7, *c*. Also note that all previously described weakened hinge lines may be applicable to the preferred embodiment with areas of weakening formed by indented portions within the plastic injection molded paddle blade's form.

FIG. 8 displays an overhead view of two, eccentric shape alternative embodiments with a first embodiment completely assembled, and positioned within a second embodiment before its folding and surrounding assembly over the first embodiment's extended shaft. A user may retain these opposing paddles while paddling and firmly gripping the outer and surrounding portion. The outermost paddle will not retain as rigid a shape as the inner paddle, but the configurement does function sufficiently in an emergency paddling situation.

A paddle's eccentric shaft may form an overall square shape for its insertion into a water craft's oar hole's aperture in multiple ways, and as shown in FIG. 6, *c*, FIG. 7, *c*, or FIG. 10, and as applied to corrugated material in alternative embodiments. A view of a shaft's distal end (31) is shown in FIG. 9, and as when an embodiment is to be injection molded, or as shown in FIG. 11, as a square shape injection molded shaft (52) is about to be inserted into a separate square shape tubular shaft handle (62).

An additional embodiment including a second and invertedly positioned paddle blade forms a double bladed kayak paddle, and is shown in FIG. 13. An optionally formed perpendicular to the flute's elongate direction weakened hinge line (74) is also shown. If a manufacturing user decides to add the weakened hinge line (74), it preferably should be made with a crimp for maximum strength. This embodiment may be folded longitudinally in half for compact storage within a canoe, kayak, or small water craft. A user's two hands may retain the foldingly assembled shape, or they may add an adhesive tape wrapping in as few as two locations. Once assembled, the multiple paralleling elongate hinge line bends (71), (72), and potentially two additional and alternative parallel weakened hinge line bends (73), will out-number and perpendicularly oppose the single perpendicular weakened hinge line crimp (74) to sufficiently retain the shaft handle's straightness. A third adhesive tape wrap may be added around the perpendicular crimp line (74) for additional strength.

A corrugated plastic material's properties allow for most any type of adhesive back tape to stick well, yet be removed and replaced while the tape's glue surface remains adhered to the tape. This feature allows for longitudinally positioned strips of tape to be applied by a manufacturer for a user to remove and to reposition around a folded crimp line, or anywhere on a paddle's shaft.

The ability for a user to unwrap the tape and unfold the paddle for compact storage remains an option, as this embodiment of a kayak paddle in its longitudinally folded and unassembled position is only and approximately ½ inch thick by 6 inches wide by 4 feet long.

A manufacturing user may also add one or more perpendicular weakened hinge lines, and labeled in FIG. 13 as (74') for a further folding of the paddle to achieve a smaller and more compactly folded double bladed paddle.

One additional option in manufacturing a corrugated embodiment includes sealing at least one or more flute channel openings (70) to further aid a paddle's buoyancy. Heated compression of a die cutters heated crimping blade may seal the openings, or a basic glue sealant, etc. will closingly plug the openings.

CONCLUSION, RAMIFICATIONS, AND SCOPE

Recent environmental weather changes are prompting preparations for local and record breaking flood events, and including low cost emergency water crafts and their low cost means of propulsion; wherein this new concept of an eccentric shaft forming paddle blade with sidewalls will fit the need.

A veteran paddling reader will understand the value of a backup emergency paddle which folds for compact storage within a canoe or kayak.

A novice or non-paddling reader will understand the paddle's low cost due to its manufacturing affordability within its simple design.

Accordingly, the reader will also see that the scope of this new paddle blade with sidewalls forming an eccentric shaft goes beyond it's many advantages over previous paddle blades, and wherein any specificities not mentioned shall be considered to be all inclusive; and including any hundreds of chemical combinations to produce a polymer plastic or co-polymer plastic, or any multiples thereof in the forming of this new concept of a paddle blade with sidewalls forming an eccentric shaft.

Summarily, this paddle blade and shaft is foldable from a flat and planar position into a rigid and functional oar with an at least 3 faceted or more shaft or shaft handle; and where the structural shape may be retained by a cooperatingly receptive aperture or hole, or another shaft's receptive shape, or a human user's hand(s), and also without a required need for any other additional substrates.

Thank you for the chance to apply for this application for patent.

We claim:

1. A paddle blade and shaft comprising;

i. a single generally flat elongate polymer plastic substrate, wherein said substrate comprises at least two angularly directioned weakened hinge lines (71) which extend inwardly and angularly from locations at or near one elongate end of said substrate's lateral exterior edges to form ii. an elongate generally triangular shape blade having a generally flat planar surface (58), and a free terminal end (30), and sidewalls (46), wherein said sidewalls (46) are parallel with and adjacent to said angularly directioned weakened hinge lines (71);

and wherein said substrate additionally comprises at least two or more paralleling directioned weakened hinge lines (72), wherein said paralleling directioned lines (72) parallel an elongate direction of said substrate to form iii. a shaft having a distal end (31) and an at least three or more sided elongate tubular shape (50)(51), and wherein said paralleling lines (72) extend from said blade to said distal end (31).

2. Said paddle blade and shaft as recited in claim 1, and further comprising;

said substrate being a corrugated plastic material having elongate flute channels (70) paralleling an elongate direction of said substrate.

3. Said paddle blade and shaft as recited in claim 1, and further comprising;

an angular difference in axis (59) between said blade's planar surface and said shaft's elongate tubular shape (50)(51).

4. Said paddle blade and shaft as recited in claim 1, and further comprising;

said at least three or more sided tubular shape shaft (50),(51) comprises at least two or more additional said paralleling weakened hinge lines (72),(73), and at least two elongate tabular projections (42), wherein said shaft is further strengthened.

5. Said paddle blade and shaft as recited in claim 4, and further comprising;

said shaft forming a four sided or square shape tubular shape shaft (52).

6. Said paddle blade and shaft as recited in claim 1, and further comprising;

a second invertedly structured said paddle blade located at said shaft's distal end (31), wherein a double bladed kayak paddle is formed.

7. Said paddle blade and shaft as recited in claim 6, and further comprising;

at least one or more weakened hinge line(s) (74) located perpendicularly to and near a centered portion of an elongate direction of said shaft.

8. Said paddle blade and shaft as recited in claim 1, and further comprising;

at least one or more flute channel (70) opening(s) being closingly plugged, sealed or filled to further aid said paddle blade and shaft's buoyancy.

9. Said paddle blade and shaft as recited in claim 1, and further comprising;

said shaft forming a 3 sided or U-shape channel tubular shape shaft (50).

10. Said paddle blade and shaft as recited in claim 1, and further comprising;

said shaft forming a 3 sided or triangular tubular shape shaft (51).

11. Said paddle blade and shaft as recited in claim 1, and further comprising;

said single flat substrate being foldable to form said paddle blade and shaft.

* * * * *